US005418554A

United States Patent [19]

Kiguchi et al.

[11] Patent Number: 5,418,554

[45] Date of Patent: May 23, 1995

[54] IMAGE RECORDING APPARATUS WITH RECORDING SHEET AND INK SHEET WIDTH DETECTION

[75] Inventors: Masao Kiguchi; Minoru Yokoyama, both of Yokohama; Yasushi Ishida, Tokyo; Akihiro Tomoda, Yokohama; Masakatsu Yamada, Yokohama; Takashi Awai, Yokohama; Takehiro Yoshida, Tokyo; Makoto Kobayashi, Tama; Satoshi Wada, Kawasaki; Takeshi Ono; Tomoyki Takeda, both of Yokohama, all of Japan

[73] Assignee: Canon Kabushiki Kaisha, Tokyo, Japan

[21] Appl. No.: 131,915

[22] Filed: Oct. 4, 1993

Related U.S. Application Data

[63] Continuation of Ser. No. 860,241, Mar. 27, 1992, abandoned, which is a continuation of Ser. No. 482,837, Feb. 21, 1990, abandoned.

[30] Foreign Application Priority Data

Feb. 21, 1989 [JP] Japan ..... 1-39267
Jul. 10, 1989 [JP] Japan ..... 1-175550
Feb. 20, 1990 [JP] Japan ..... 2-37446

[51] Int. Cl.[6] ..... B41J 2/32
[52] U.S. Cl. ..... 347/215
[58] Field of Search ..... 346/76 PH, 1.1; 400/207 E, 237 E, 613, 708, 247, 76

[56] References Cited

U.S. PATENT DOCUMENTS 4,456,392 6/1984 Nozaki et al. ..... 400/120
4,724,447 2/1988 Oda ..... 346/76 PH X
4,896,167 1/1990 Hayakawa ..... 346/76 PH
4,899,171 2/1990 Ogura et al. ..... 346/76 PH

FOREIGN PATENT DOCUMENTS 0217571 4/1987 European Pat. Off. .
0319271 6/1989 European Pat. Off. .
57-83471 5/1982 Japan .
62-58917 1/1983 Japan .
58-201686 11/1983 Japan .
95177 6/1984 Japan .
49978 3/1985 Japan .

OTHER PUBLICATIONS

Microprocessing & Microprogramming, Feb. 19, 1987, vol. 19, No. 2, pp. 153–166, D. Del Corso et al., An Integrated Controller for Modified Inter-Integrated Circuit Protocol.

*Primary Examiner*—Benjamin R. Fuller
*Assistant Examiner*—N. Le
*Attorney, Agent, or Firm*—Fitzpatrick, Cella, Harper & Scinto

[57] ABSTRACT

An image recording apparatus is improved by providing mounting section for mounting and conveying an ink sheet and a recording medium in good condition, discriminating devices for detecting and discriminating width sizes of the ink sheet and the recording medium, a recording unit for recording an image on the recording medium by effecting the ink sheet, and a control unit for controlling a recording operation according to a detection result obtained through the discriminating devices. The image is thus ready for recording subject to the width sizes of both ink sheet and recording medium being coincident.

24 Claims, 14 Drawing Sheets

IMAGE RECORDING APPARATUS WITH RECORDING SHEET AND INK SHEET WIDTH DETECTION

This application is a continuation of application Ser. No. 07/860,241, filed Mar. 27, 1992, now abandoned, which was a continuation of application Ser. No. 07/482,837, filed Feb. 21, 1990, also now abandoned.

BACKGROUND OF THE INVENTION

1. Field of the Invention

The present invention relates to an image recording apparatus for recording on a recording medium.

2. Related Background Art

A prior art image recording apparatus is exemplified typically by a heat transfer type facsimile equipment using an ink sheet thereon. The equipment detects a width of loaded or mounted recording sheet to control a data recording width.

However, a width of the ink sheet has not been detected hitherto, thus bringing about the following disadvantage. That is, if a B4-sized recording sheet is mounted despite having mounted, for example, an A4-sized ink sheet, the equipment decides a recordable size as B4, and so comes into a recording operation. However, the ink sheet width actually covers only the A4-size, and thus an image is recorded only in an A4-size domain where the ink sheet is present, but the image cannot be recorded in a recording sheet domain where the ink sheet is not present.

On the other hand, in the case of multiprint recording system, the following problem may arise inevitably.

First, a heat transfer printer will be described before going into multiprint.

Generally, the heat transfer printer uses an ink sheet with a heat-soluble (heat-sublimable) ink applied on a base film, and heats the ink sheet selectively on a thermal head according to an image signal thereby transferring the dissolved (sublimated) ink onto a recording sheet to image recording. Generally, the ink sheet is that of having the ink transferred perfectly on the recording sheet whenever the image is recorded (or so-called one-time sheet), therefore it is necessary that the ink sheet be conveyed so long as will correspond to the recorded length after recording one character or one line, and an unused portion of the ink sheet positioned accurately for the next recording. Consequently, the ink sheet is used increasingly, and a running cost of the heat transfer printer trends high as compared with a normal printer operating for recording on a heat-sensitive paper.

To solve such problems, there is proposed a heat transfer printer for conveying a recording sheet and an ink sheet at a speed difference provided therebetween as disclosed in Japanese Laid-Open Patent Application No. 57-83471 and Japanese Laid-Open Patent Application No. 58-201686 and also Japanese Patent Publication No. 62-58917.

Here, an ink sheet ready for recording images more than one time (or so-called multiprint sheet) is known as the ink sheet available for lowering a running cost of the heat transfer printer. From using the ink sheet, a recording length L can be recorded continuously with a conveying length of the ink sheet conveyed after end of each image recording or during the image recording adjusted to be less than the length L ($L/n$: $n>1$). Thus, a merit of the ink sheet becomes n times of the conventional one, and a reduction in running cost of the heat transfer printer can be expected. Such recording system is called multiprint hereinafter.

In such multiprint system, since a conveying speed of the ink sheet is lower than the conveying speed of a recording sheet, it is necessary that a speed difference be taken between a rotational speed of a platen for conveying the recording sheet and the conveying speed of the ink sheet. Where the recording sheet is present between the ink sheet and the platen, the ink sheet slides well against the recording sheet as a friction factor of the recording sheet is small, however, once the range in which the ink sheet comes in contact directly with the platen gets large, a trouble may arise on conveying the ink sheet as a friction factor of the platen is large. This may cause wrinkles, breakage or other failures on the ink sheet, and thus is capable of bringing about a defect of image recording and a deterioration in image quality.

SUMMARY OF THE INVENTION

An object of the invention is to provide a image recording apparatus capable of enhancing an image quality.

Another object of the invention is to provide an image recording apparatus capable of preventing a defect of image recording.

A further object of the invention is to provide an image recording apparatus capable of conveying an ink sheet in good condition.

An even further object of the invention is to provide an image recording apparatus so as not to miss an image to be recorded in view.

Another object of the invention is to provide an image recording apparatus capable of detecting the width of an ink sheet.

An additional object of the invention is to provide a heat transfer recording apparatus capable of recording an image when sizes of a recording sheet and an ink sheet are coincident, thereby preventing wrinkles and breakage of the ink sheet due to a friction between the ink sheet and a platen.

DETAILED DESCRIPTION OF THE PREFERRED EMBODIMENTS

Embodiments of the invention will now be described in detail with reference to the accompanying drawings.

Figure 1:
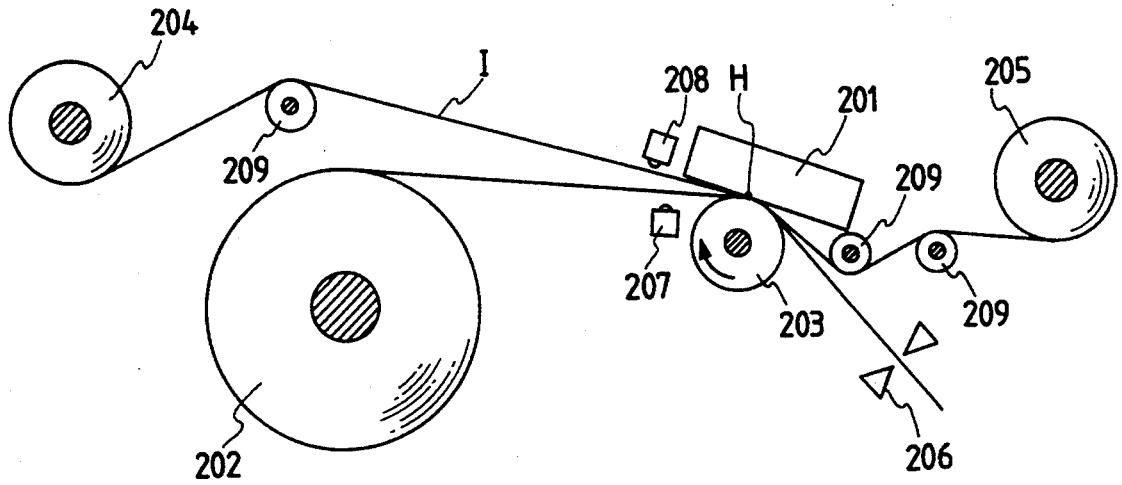
FIG. 1 is a sectional view of a recording mechanism portion of an image recording apparatus embodying the invention.

FIG. 1 is a sectional view of a recording mechanism portion of an image recording apparatus embodying the invention. In the illustration, 201 represents a thermal head, provided with a plurality of heat generating elements H for generating heat selectively according to an image information, applying heat to an ink sheet I to transfer an ink of the ink sheet I onto a recording sheet 202, thereby recording the image. A reference numeral 202 represents a recording sheet, which is mounted in roll-shape. A reference numeral 203 represents a platen for feeding the recording sheet 202. A reference numeral 204 represents a feed roll to feed the ink sheet I. A reference numeral 205 represents a take-up roll to take up the used ink sheet I. A reference numeral 206 represents a cutter to cut the recording sheet 202 after recording. A reference numeral 207 represents a reflective photosensor to detect a width of the recording sheet 202. A reference numeral 208 also represents a reflective photosensor to detect a width of the ink sheet I. A reference numeral 209 represents a guide roller to guide the ink sheet I for running.

Figure 2:
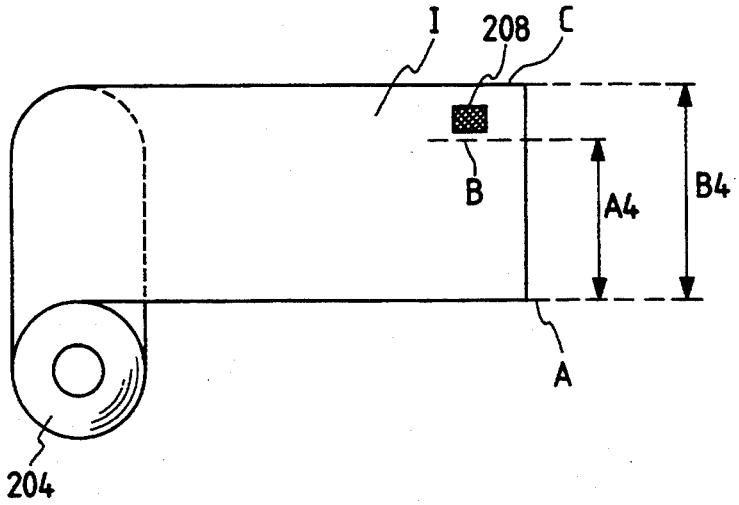
FIG. 2 is a conceptional drawing illustrating a method embodying the invention for detecting a recording sheet width and an ink sheet width.

FIG. 2 is a conceptional drawing for illustrating a method embodying the invention for detecting the recording sheet width and the ink sheet width. In the illustration, if, for example, point A is a common start point, then a spot coming in an A4 length of the ink sheet width therefrom is point B, and a spot coming in a B4 length of the recording sheet width is point C. The reflective photosensor 208 will be provided between the point B and the point C, thus discriminating A4-size or B4-size of a width of the fed ink sheet.

Figure 3:
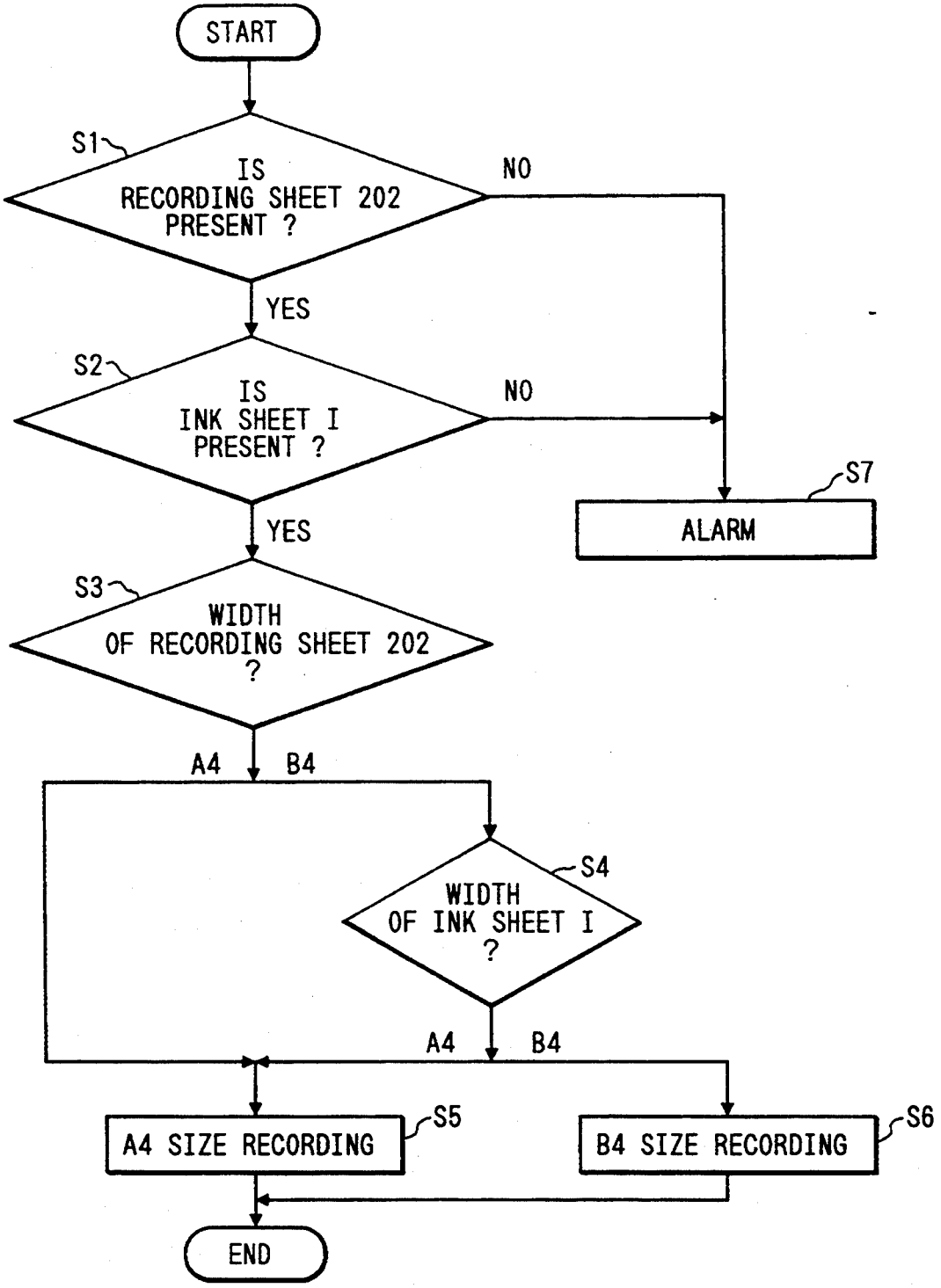
FIG. 3 is a flowchart embodying the invention for control of the recording sheet width.

FIG. 3 is a flowchart of a recording width control embodying the invention. In the illustration, first whether or not the recording sheet is present is checked through a sensor (not indicated) in STEP S1. When the recording sheet 202 is not mounted, the process goes forward to STEP S7 for incapableness of the recording, and an alarm is generated. Then when the recording sheet 202 is present, whether or not the ink sheet I is mounted is checked likewise in STEP S2. When the ink sheet I is not mounted, the process goes forward to STEP S7 likewise, and an alarm is generated. Then, when the ink sheet I is mounted, the process goes forward to STEP S3 for ready operation of a minimum recording, and the recording sheet width is detected. When the recording sheet width is A4-size, the A4 width is recorded immediately in STEP S5. The reason is that the ink sheet width may take both A4- and B4-sizes, if the recording sheet width is A4-size. Then, when the recording sheet width is B4-size, the ink sheet width is detected in STEP S4. When the ink sheet width is B4-size, the process goes forward to STEP S6 to record the B4 width. When the ink sheet width is A4-size, the process goes forward to STEP S5 to record the A4 width. For example, even when a receiving information is B4 width, the size is contracted to A4 width to recording.

Further, a reflective photosensor is used in the above-described embodiment, however, the invention is not limited only thereto. Besides, a contact type photointerrupter with, for example, actuator and the like may be used therefor.

Then, a discrepancy between the recording sheet width and the ink sheet width {particularly (ink sheet width)<(recording sheet width)} is detected, which is decided to be an erroneous operation of users, an alarm is generated accordingly, or it is indicated on an operation panel, thereby preventing the erroneous operation on the spot.

As described above, according to the embodiment, if the A4-sized ink sheet is mounted erroneously despite a user having mounted the B4-sized recording sheet, then an alarm will be generated accordingly, or the A4-size will be decided recordable automatically, thus preventing a miss of information.

Next, the case wherein the embodiment of the invention is applied to a multiprint recording system will be described with reference to a facsimile equipment as example.

A preferred embodiment of the invention will now be described in detail with reference to the accompanying drawings.

[Facsimile Equipment (FIGS. 4A to 7)]

Figure 4A:
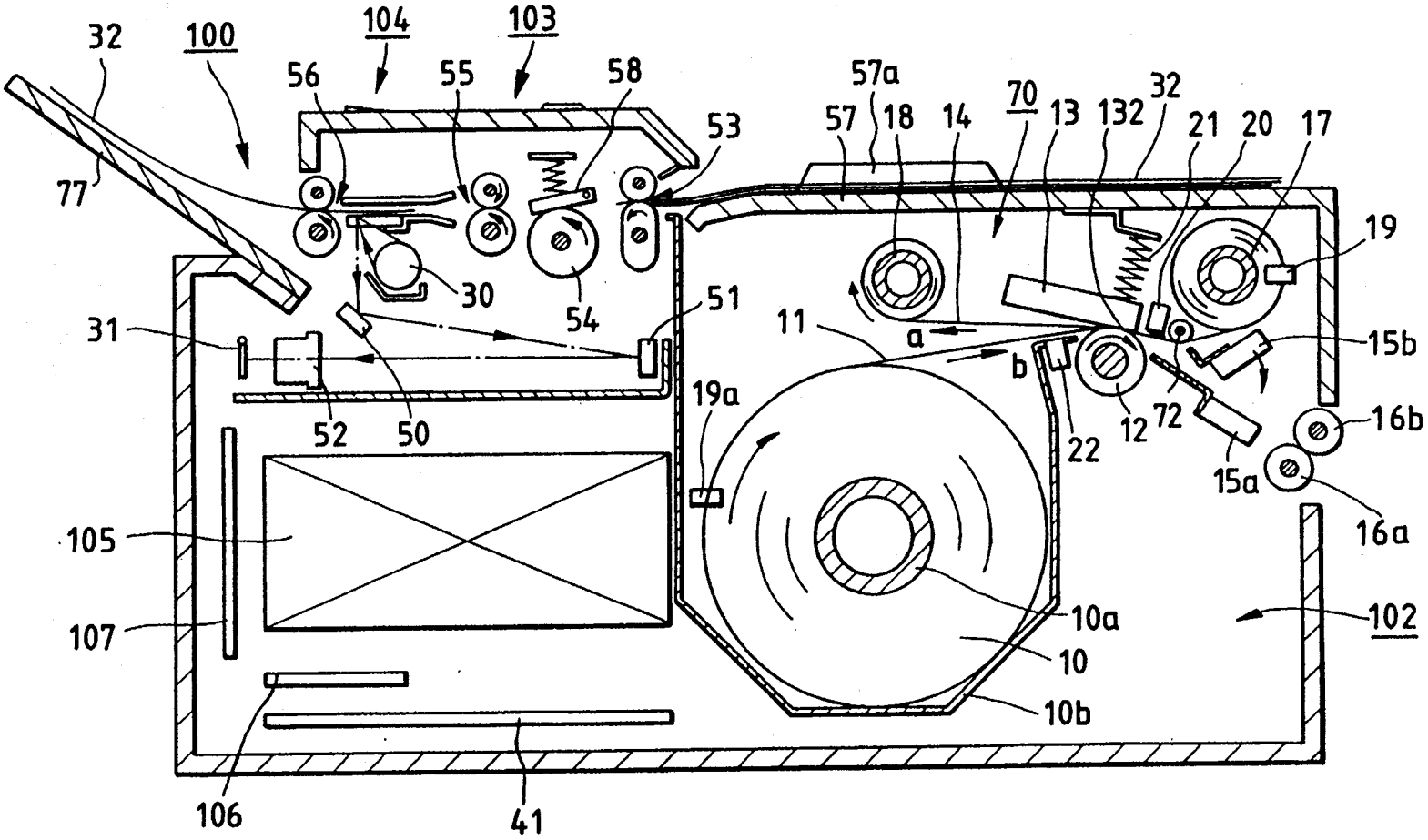
FIG. 4A is a side sectional view representing a mechanism portion of a facsimile equipment embodying the invention.
Figure 4B:
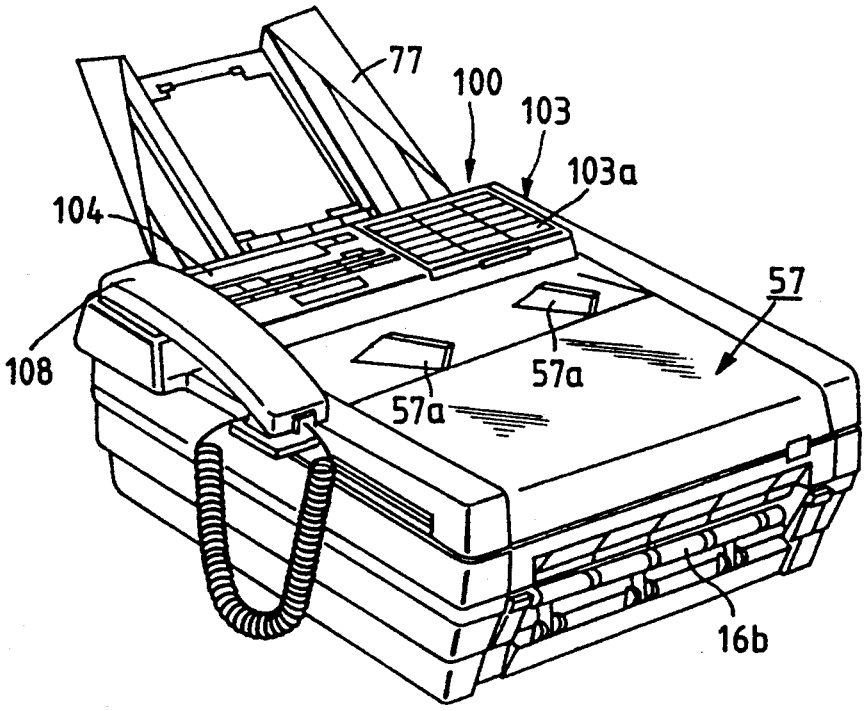
FIG. 4B is a perspective view of the facsimile equipment.
Figure 5:
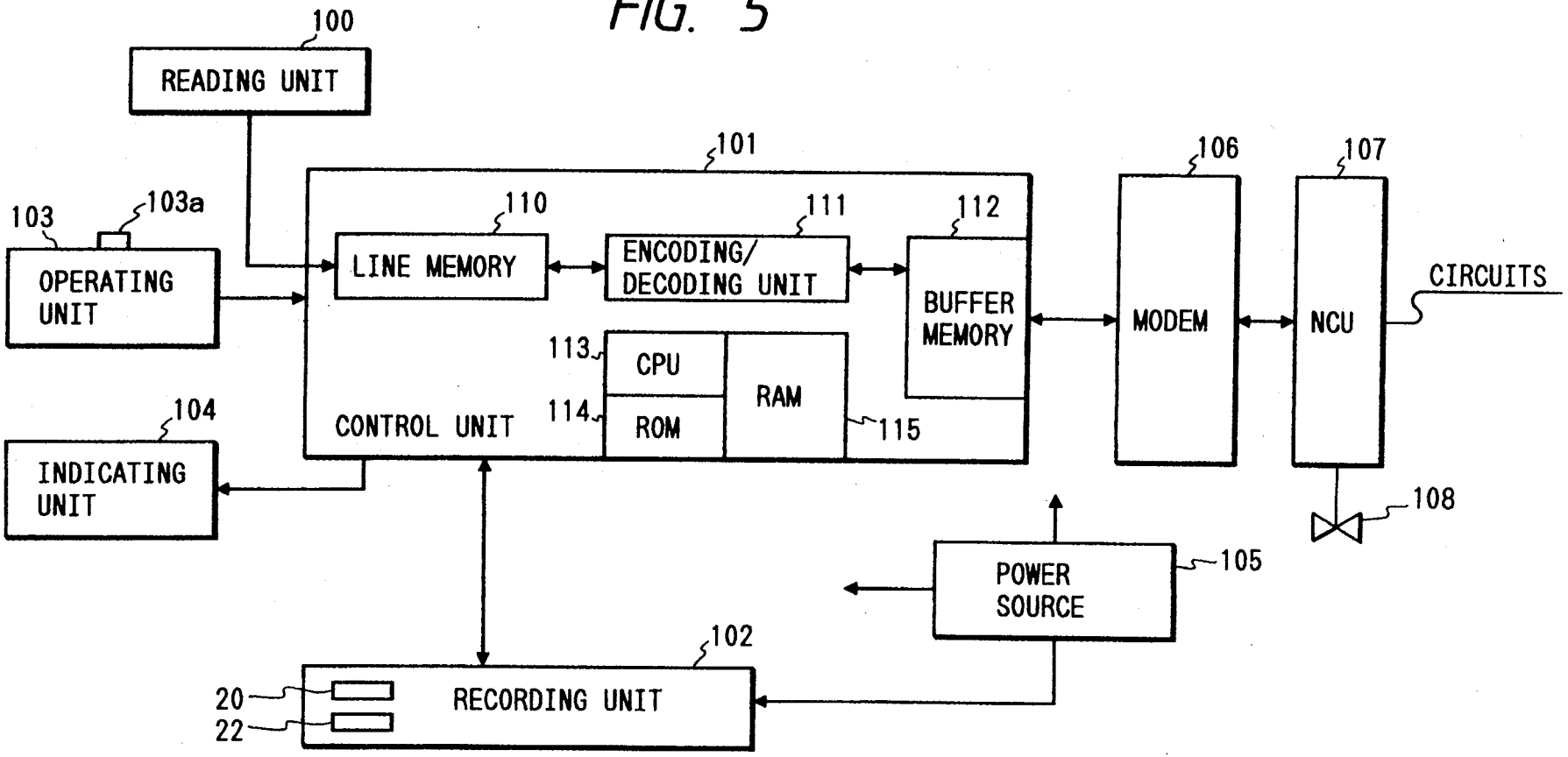
FIG. 5 is a block diagram showing a schematic construction of the facsimile equipment embodying the invention.

FIGS. 4A to 7 are drawings each representing a case where a heat transfer printer given in one embodiment of the invention is applied to the facsimile equipment. FIG. 4A is a side sectional view of the facsimile equipment, FIG. 4B is a perspective view thereof, and FIG. 5 is a block diagram showing a schematic construction of the facsimile equipment.

First, the schematic construction will be described with reference to FIG. 5.

In the drawing, 100 represents a reading unit for reading a document photoelectrically and outputting to a control unit 101 as a digital image signal, which is provided with a document conveying motor and CCD image sensor. Next, a construction of the control unit 101 will be described. A reference numeral 110 represents a line memory for storing image data of each line of an image data, in which an image data for one line from the reading unit 100 is stored for sending or copying a document, and a one-line data of a decoded image data is stored for receiving the image data. Then, the stored data is outputted to a recording unit 102, thereby forming an image. A reference numeral 111 represents an encoding/decoding unit for encoding an image to be sent through MH encoding or other means, and decoding a received image data to convert into an image data. A reference numeral 112 represents a buffer memory for storing an encoded image data to be sent or received. Each part of the control unit 101 is controlled by CPU 113 such as, for example, microprocessor or the like. Other than CPU 113, the control unit 101 comprises ROM 114 for storing a control program of CPU 113 and various data, and RAM 115 for storing various data temporarily working area for CPU 113.

A reference numeral 102 represents a recording unit provided with a thermal line head, operating for recording the image on a recording sheet according to a heat transfer recording process. In the recording unit 102, 20 represents an ink sheet width sensor, 22 represents a recording sheet width sensor, which will be described in detail hereinlater. Then, a construction of the recording unit 102 will also be described in detail hereinlater with reference to FIG. 1. A reference numeral 103 represents an operating unit including an indicating key for various functions such as sending start and others and an input key for telephone numbers, 103*a* represents a switch for indicating a kind of ink sheet 14 to work, the switch 103*a* being on indicates that a multiprint ink sheet is mounted, while its being off indicates that an ordinary ink sheet is mounted. A reference numeral 104 then represents an indicating unit for indicating normally a state of various functions and devices provided on the operating unit 103. A reference numeral 105 represents a power source for feeding power to the apparatus throughout. Further, 106 represents a modem (modulator and demodulator) for AC-DC changeover of facsimile singal and others, 107 represents a network control unit (NCU) for communication control between circuits, and 108 represents a telephone set provided with a telephone dial and others.

Next, a construction of the recording unit 102 will be described in detail with reference to FIG. 4. Then, like reference numerals represent like parts of FIG. 5.

In the drawing, 10 represents a sheet roll with a common recording sheet 11 wound in roll on a core 10*a*. The sheet roll 10 is contained rotatably in the apparatus so as to feed the recording sheet 11 to a thermal head 13 according as a platen 12 rotates in the direction indicated by an arrow. Then, 10*b* represents a sheet roll mounting part, mounting the sheet roll 10 detachably therein. Further, 12 represents a platen, which conveys the recording sheet 11 in the direction indicated by an arrow b and also presses the ink sheet 14 and the recording sheet 11 against a heat generating member 132 of a thermal head 13. The recording sheet 11 with an image recorded thereon according to a heat generation of the thermal head 13 is conveyed in the direction of discharge rollers 16*a* and 16*b* according to a further rotation of the platen 12, and whenever the image for one page is recorded, it is cut in pages according to an engagement of cutters 15*a* and 15*b* and then discharged.

A reference numeral 17 represents an ink sheet feed roll with the ink sheet 14 wound thereon, 18 represents an ink sheet take-up roll, which is driven by an ink sheet conveying motor described hereinlater and takes up the ink sheet 14 in the direction indicated by an arrow a. Then, the ink sheet feed roll 17 and the ink sheet take-up roll 18 are mounted detachably on an ink sheet mounting part 70 within an apparatus body. Further, 19 represents a sensor for detecting a residual amount of the ink sheet 14 and also for detecting a conveying speed of the ink sheet 14. Then, 20 represents an ink sheet width sensor for detecting a width (A4- or B4-size, for example) of the ink sheet 14, and 21 represents a spring for pushing the thermal head 13 onto the platen 12 through the recording sheet 11 and the ink sheet 14. A reference numeral 22 represents a recording sheet width sensor for detecting a width (for example A4- or B4-size) of the recording sheet 11. Then, 72 represents a roller, which guides the ink sheet 14.

A construction of the reading unit 100 will be described, next.

In the drawing, 30 represents a light source for irradiating a document 32, a light reflected by the document 32 is inputted to CCD sensor 31 through an optical system (comprising mirrors 50, 51 and lens 52), and is then transformed into an electrical signal. The document 32 is conveyed correspondingly to a reading speed of the document 32 on conveying rollers 53, 54, 55 and 56 driven by a document conveying motor which is not indicated therein. Then, 57 represents a document stand, a plural sheet of documents 32 are separated sheet by sheet, an guided by a slider 57*a*, through a cooperative operation of the conveying roller 54 and a push separator 58, conveyed then to the reading unit 100 and discharged to a tray 77 after reading.

A reference numeral 41 represents a control substrate constructing a main part of the control unit 101, and various control signals are outputted to each part of the apparatus from the control substrate 41. Then, 106 represents a modem substrate unit, and 107 represents an NCU substrate unit.

Figure 6:
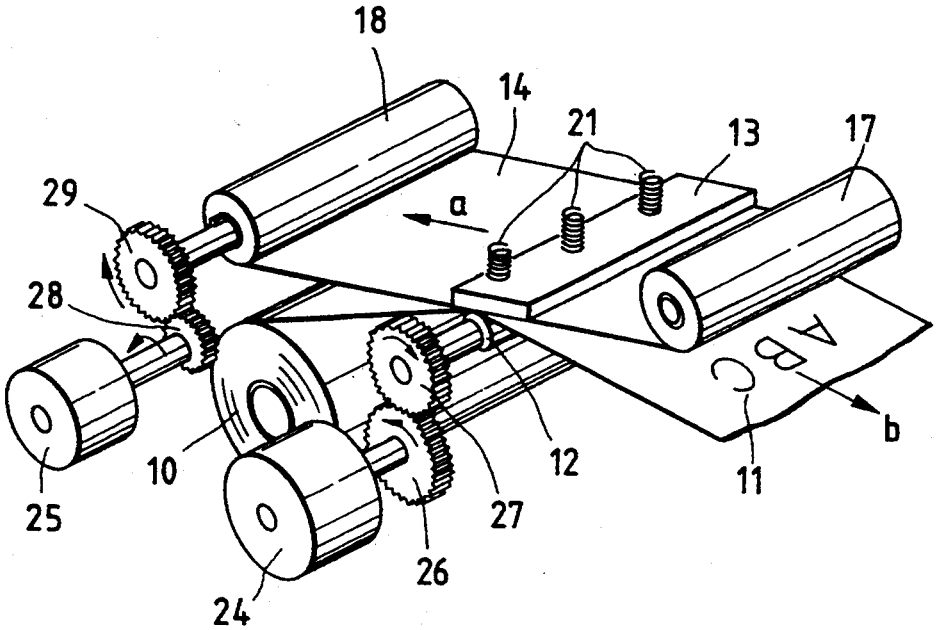
FIG. 6 is a drawing showing a structure of the conveying system of an ink sheet and a recording sheet.

Further, FIG. 6 is a drawing showing in detail a conveying mechanism for the ink sheet 14 and the recording sheet 11.

In the drawing, 24 represents a recording sheet conveying motor for driving the platen 12, thereby conveying the recording sheet 11 in the direction indicated by an arrow b which is counter to the direction indicated by an arrow a. Then, 25 represents an ink sheet conveying motor for conveying the ink sheet 14 in the direction indicated by the arrow a. Further, 26 and 27 represent transfer gears for transferring a rotation of the recording sheet conveying motor 24 to the platen 12, and 28 and 29 represent transfer gears for transferring a rotation of the ink sheet conveying motor 25 to the take-up roll 18.

The direction in which images are sequentially recorded in the direction longitudinal of the recording sheet 11 (the direction indicated by the arrow a, namely the direction counter to that in which the recording sheet 11 is conveyed) and the direction in which the ink sheet 14 is conveyed come to coincide from reversing thus the directions in which the recording sheet 11 and the ink sheet 14 are conveyed. Here, assuming that a conveying speed $V_P$ of the recording sheet 11 is $V_P = -n \cdot V_I$ ($V_I$ being a conveying speed of the ink sheet 14;—indicating that the direction in which the recording sheet 11 is conveyed and that in which the ink sheet 14 is conveyed are different), a relative speed $V_{PI}$ of the recording sheet 11 and the ink sheet 14 to the thermal head 13 will be expressed as:

$$V_{PI} = V_P - V_I = (1 + 1/n) V_P$$

Besides, there is a method wherein the ink sheet 14 is conveyed in the direction indicated by the arrow a by (l/m) (m being an integer, $n > m$) at every (n/m) lines for recording n lines on the thermal head 13, and also a method wherein the ink sheet 14 is conveyed counter to the recording sheet 11 at the same speed thereof during recording, and the ink sheet 14 is rewound by $L \cdot (n-1)/n$ (where $n > 1$) before the next recording of a predetermined amount for recording a distance corresponding to the length L. In either case, the relative speed when recording as stopping the ink sheet 14 is $V_P$, and the relative speed when recording as shifting the ink sheet 14 is $2V_P$.

Figure 7:
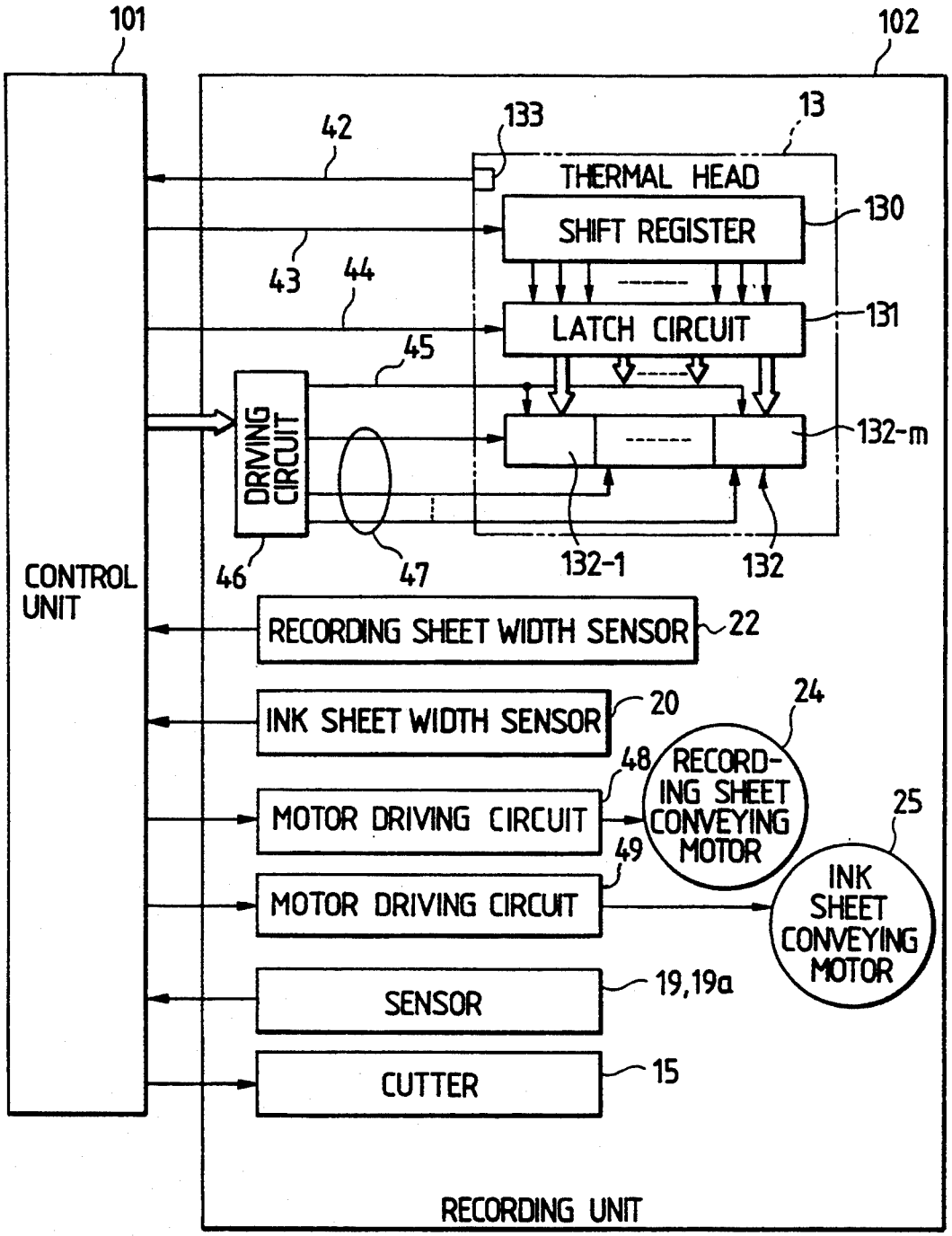
FIG. 7 is an electrical connection diagram of a control unit and a recording unit of the facsimile equipment embodying the invention.

FIG. 7 is a drawing showing an electrical connection of the control unit 101 and the recording unit 102 of a facsimile equipment of the present embodiment, wherein like reference numerals represent like parts in the different views of the drawings.

The thermal head 13 is a line head. Then, the thermal head 13 comprises a shift register 130 for inputting a serial recording data 43 for one line from the control unit 101, a latch circuit 131 for latching data of the shift register 130 on a latch signal 44, and a heat generating element 132 consisting of heat generating resistant members for one line. Here, the heat generating element 132 is divided into m pieces of blocks indicated by **132-*l* to 132-*m* and so driven. Then, 133 represents a temperature sensor mounted on the thermal head 13 for detecting temperatures of the thermal head 13. An outgoing signal 42 of the temperature sensor 133 is subjected to A/D conversion in the control unit 101 and inputted to CPU 113. Thus, CPU 113 detects temperatures of the thermal head 13, modifies a pulse width of a strobe signal 47 correspondingly thereto, or modifies a driving voltage of the thermal head 13, thereby adjusting an energy to be impressed on the thermal head 13 according to characteristics of the ink sheet 14. A kind (characteristics) of the ink sheet 14 is indicated by operators manipulating the switch 103*a*. Then, the kind and characteristics of the ink sheet 14 may be discriminated either by detecting automatically a mark printed on the ink sheet 14** or by detecting automatically a mark, a notch or a projection put on a cartridge of the ink sheet.

A reference numeral 46 represents a driving circuit for inputting a driving signal of the thermal head 13 from the control unit 101, and generating the strobe signal 47 for driving the thermal head 13 in blocks. Then, upon instruction of the control unit 101, the driving circuit 46 may change a voltage outputted to a power line 45 for feeding a current to the heat generating element 132 of the thermal head 13, thereby adjusting an energy to be impressed on the thermal head 13. Reference numerals 48, 49 represent motor driving circuits for driving the recording sheet conveying motor 24 and the ink sheet conveying motor 25 respectively. The recording sheet conveying motor 24 and the ink sheet conveying motor 25 are stepping motors in the embodiment, however, the invention is not necessarily limited thereto, and hence a DC motor, for example, may be used otherwise.

[Detection of Widths of Ink Sheet and Recording Sheet (FIGS. 8A–8D)]

Normally, a width of the recording sheet used on a facsimile equipment is A4- or B4-sized, therefore a case of the facsimile equipment capable of coping with the two kinds of recording sheet widths will be taken up for description, here.

As shown in FIGS. 4A, 4B, 5 and 7, a width of the recording sheet 11 is detected on the recording sheet width sensor 22, and a width of the ink sheet 14 is detected on the ink sheet width sensor 20. Then, the sensor 20 is disposed on a side end portion of a conveying path of the B4-sized ink sheet 14, and the sensor 22 is disposed on a side end portion of a conveying path of the B4-sized recording sheet 11. Further, the sensor 20 is disposed on an upstream side of the direction in which the ink sheet 14 is conveyed to a recording position, and the sensor 22 is disposed on an upstream side of the direction in which the recording sheet 11 is conveyed to the recording position.

Figure 8A:
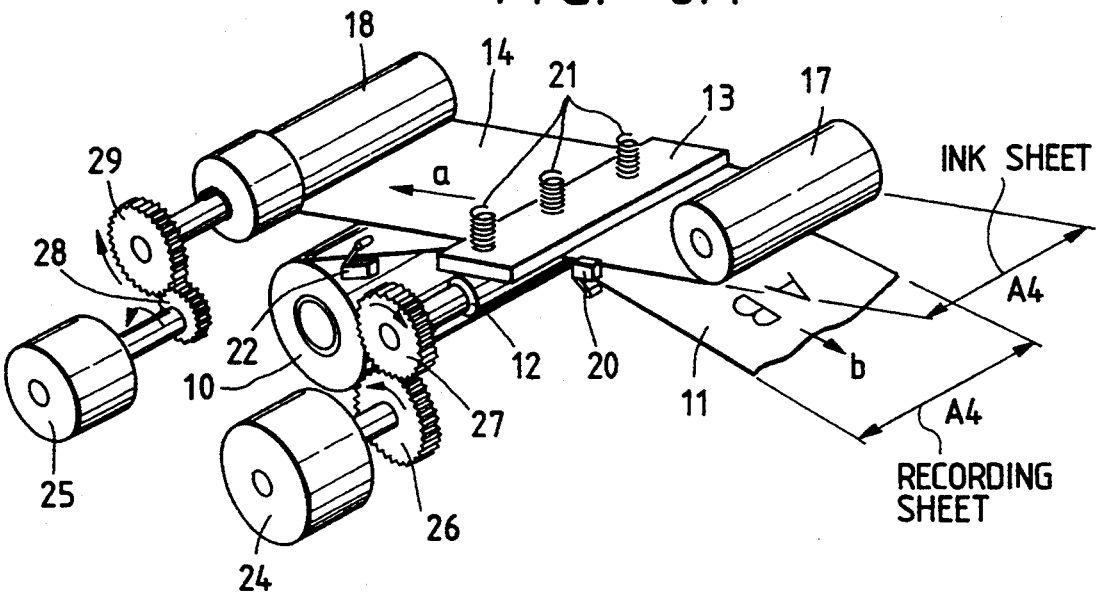
FIGS. 8A to 8D are drawings representing a combination of sizes of the recording sheet and the ink sheet each.
Figure 8B:
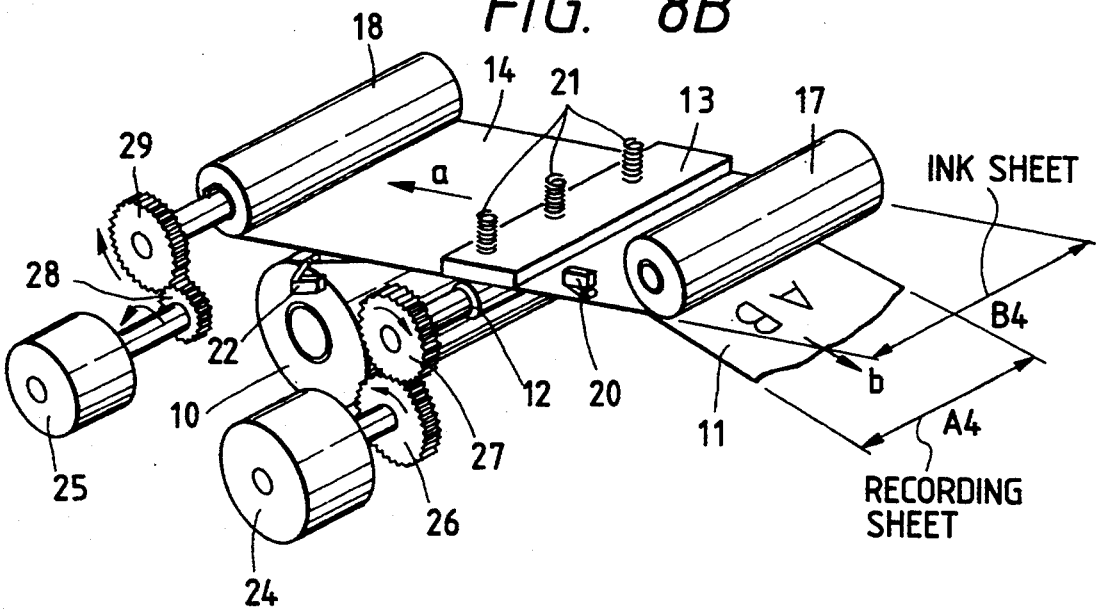

FIGS. 8A to 8D are drawings showing a state where widths of the recording sheet 11 and the ink sheet 14 are detected. In FIG. 8A, since the ink sheet width sensor 20 and the recording sheet width sensor 22 are turned off both, both are detected as A4-sized. In FIG. 8B, while the ink sheet width sensor 20 is depressed by the ink sheet 14 to be on, the recording sheet width sensor 22 is kept off as in the case of FIG. 8A. Thus, it is found that the ink sheet 14 is B4-sized, and the recording sheet 11 is A4-sized.

Figure 8C:
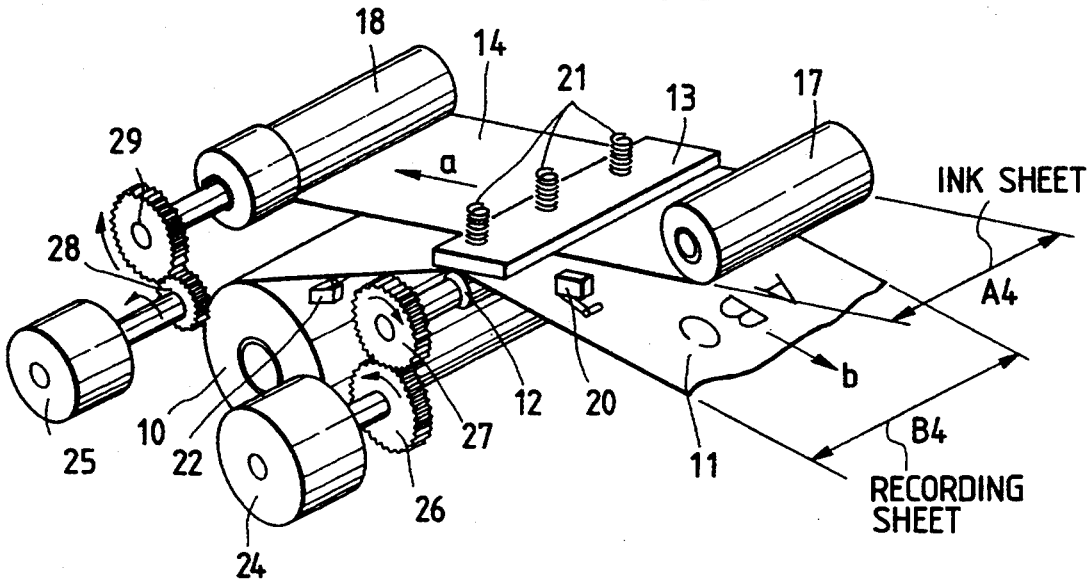
Figure 8D:
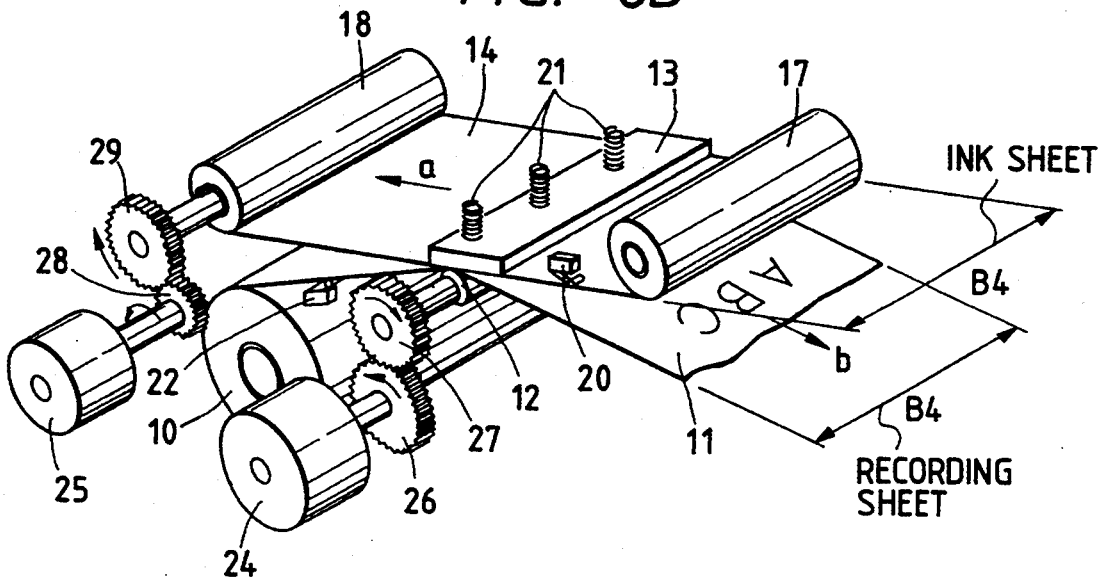

In FIG. 8C, since the recording sheet width sensor 22 is depressed by the recording sheet 11, the recording sheet 11 is recognized as B4-sized. Then, the ink .sheet width sensor 20 is turned off, therefore it can be detected that the ink sheet 14 is A4-sized. FIG. 8D indicates the case where the ink sheet 14 and the recording sheet 11 are both B4-sized, and thus the ink sheet width sensor 20 and the recording sheet width sensor 22 are turned off both.

Next, a relation between a detected state by each sensor and an operation of the facsimile equipment will be described.

TABLE

| | Recording sheet width sensor 22 | Ink sheet width sensor 20 | Decision of facsimile |
|---|---|---|---|
| 1 | OFF (A4) | OFF (A4) | Operating normally |
| 2 | OFF (A4) | ON (B4) | Error indicated |
| 3 | ON (B4) | OFF (A4) | Error indicated |
| 4 | ON (B4) | ON (B4) | Operating normally |

The above table shows an operating state of the facsimile equipment corresponding to a detected state by the ink sheet width sensor 20 and a detected state by the recording sheet width sensor 22. It is confirmed experimentally that when the ink sheet 14 and the recording sheet 11 are almost of a width, the ink sheet 14 can be conveyed without trouble on recording quality of an image even if a peripheral speed of the platen 12 and a speed of the ink sheet 14 are different or counter in the direction. Thus, as indicated by Nos. 1 and 4 of the above table, the facsimile equipment operates normally when the recording sheet 11 and the ink sheet 14 are of a size.

In the case of No. 3 of the table, if a conveyance only of the ink sheet 14 is taken note of, then nothing will be problematical as the ink sheet 14 does not come in contact directly with the platen 12, however, since the ink sheet 14 is smaller in size than the recording sheet 11, the image cannot be recorded covering full width of the recording sheet 11. Accordingly, an error is indicated in this case, and an alarm for replacement of the recording sheet 11 or the ink sheet 14 is given on the indicating unit 104.

On the other hand, in the case of No. 2 of the table, since the platen 12 and the ink sheet 14 are of a speed in the same direction, no problem was brought on heat transfer recording using a conventional one-time sheet. However, when the ink sheet 14 and the recording sheet 11 are conveyed in the counter direction each other like the present embodiment, that is, in case the direction in which the ink sheet 14 is conveyed and the direction in which the platen 12 rotates are different each other, wrinkles, breakage or other defects result definitely on the ink sheet 14. Accordingly, an error is indicated on the indicating unit 104 in this case, and a user is instructed to replace the ink sheet 14.

As described, according to the embodiment, widths of the recording medium and the ink sheet are detected, and where the detected widths are different at a predetermined amount or over, an image is not recorded.

[Receiving Process (FIGS. 4A to 9)]

Figure 9:
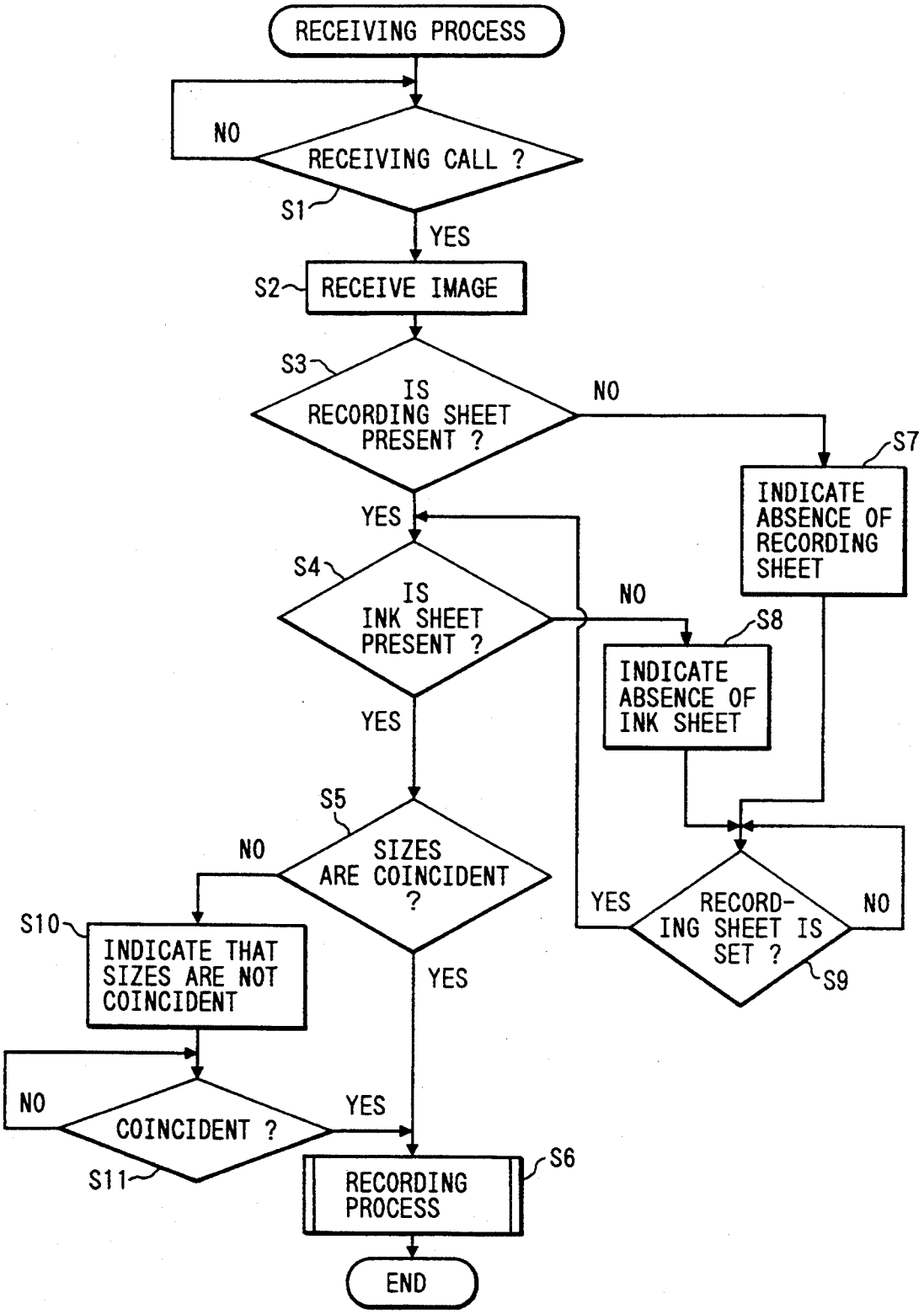
FIG. 9 is a flowchart showing a receiving process in the facsimile equipment embodying the invention.

FIG. 9 is a flowchart showing a receiving process in the facsimile equipment of the embodiment, wherein a control program for putting the process into operation is stored in ROM 114.

When there is a receiving call in STEP S1, the process goes forward to STEP S2, where a facsimile image signal is received through the modem 106. The image signal thus received is decoded and converted into an image signal, and then stored in the buffer memory 112. When the image signal has been received, the process goes forward to STEP S3, where a presence of the recording sheet 11 is ensured by a recording sheet sensor 19*a* and others. If the recording sheet 11 is present, then the process goes forward to STEP S4; and whether or not the ink sheet 14 is present is checked by the ink sheet sensor 19.

Figure 10:
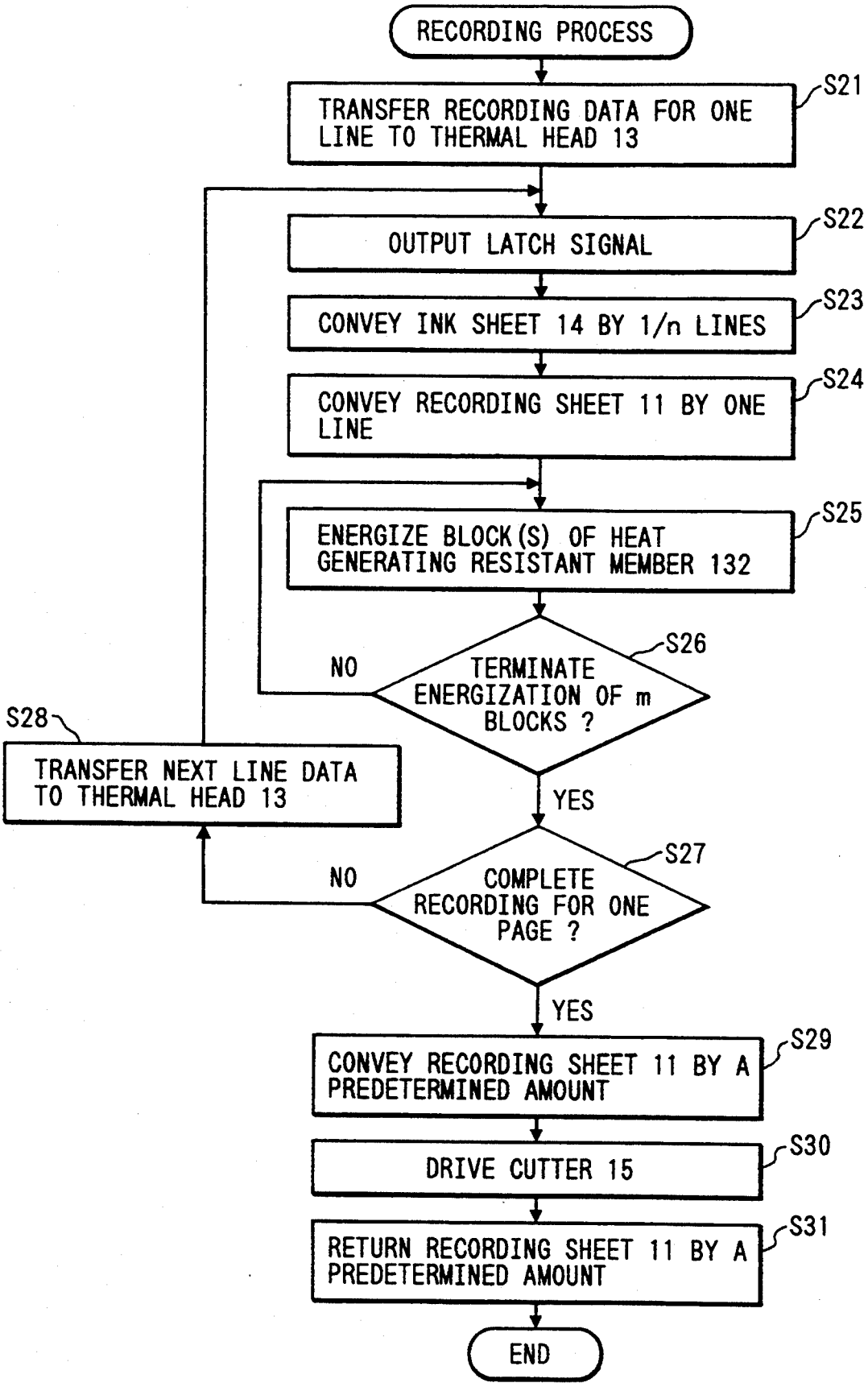
FIG. 10 is a flowchart showing a recording process of a step S6 of FIG. 9.

When the recording sheet 11 and the ink sheet 14 are both present, the process goes forward to STEP S5, and whether or not sizes of the two are coincident is decided according to outputs of the sensors 20 and 22. Then, if the sizes are coincident, the process goes forward to STEP S6, where a recording process shown in flowchart of FIG. 10 is carried out. On the other hand, if there is no recording sheet 11 found in STEP S3, the process goes forward to STEP S7, where the recording sheet being not present is indicated on the indicating unit 104, and when there is no ink sheet 14 found in STEP S4, the process goes forward to STEP S8 to indicate no presence of the ink sheet on the indicating unit 104. The process then goes forward to STEP S9 from STEP S7 and STEP S8 to wait until the ink sheet 11 is set, and when it is set, the process goes forward to STEP S5 where sizes of the recording sheet 11 and the ink sheet 14 are decided.

Then, if the sizes are not coincident in STEP S5, the process goes forward to STEP S10, where sizes of the recording sheet 11 and the ink sheet 14 being not coincident is indicated on the indicating unit 104. Then, at least either the ink sheet 14 or the recording sheet 11 is replaced in STEP S11, and whether or not both sizes are coincident is checked. When both sizes come to coincide, the process goes forward to STEP S6, and goes into recording shown in flowchart of FIG. 7. Then, a width of the ink sheet may be detected on the ink sheet sensor 19, and a width of the recording sheet may also be detected on the recording sheet sensor 19*a*, thereby omitting the sensors 20 and 22.

[Recording Operation (FIGS. 4A to 10)]

FIG. 10 is a flowchart showing a recording process for one page on the facsimile equipment of the present embodiment, which is shown in STEP S6 of FIG. 9.

The process is started when an image data for one line to record is stored in the line memory 110 to a state ready for recording operation. First, a recording data for one line is outputted serially to the shift register 130 in STEP S21. Then, whenever the recording data for one line is transmitted, the latch signal 44 is generated in STEP S22, and the recording data for one line is stored in the latch circuit 131. Next the ink sheet motor 25 is driven in STEP S23, and the ink sheet 14 is conveyed by (1/n) lines in the direction indicated by the arrow a in FIG. 4. Then, the recording sheet conveying motor 24 is driven in STEP S24, and the recording sheet 11 is conveyed for one line in the direction indicated by the arrow b. The one line is so long as will correspond to the length of one dot recorded by the thermal head 13.

Next the process goes forward to STEP S25, where a current is carried to each block of the heat generating element 132 of the thermal head 13. Then, whether or not the current has been carried to all the blocks m is checked in STEP S26, and if all the blocks of the heat generating element 132 are so conducting and a recording for one line is thus over, the process goes forward to STEP S27, and whether or not the recording for one page is over is checked. When the recording for one page has not been over, the process goes forward to STEP S28, where a recording data for the next line is transmitted to the thermal head 13, and the process returns to STEP S22.

Then, in a series of cutter operation covering STEP S27 to STEP S31, the ink sheet 14 when the recording sheet 11 is conveyed may be conveyed at $V_P/n$ in the direction counter to the recording sheet 11 as in the case of image recording, and a value of n may be taken greater than that at the time of recording. Further, a move same as the recording sheet 11 may be realized on the platen 12 and others or as keeping the ink sheet 14 stopped.

When the recording for one page is over in STEP S27, the process goes forward to STEP S29, where the recording sheet 11 is fed by a predetermined amount in the direction of the discharge rollers 16*a*, 16*b*. Then, the cutters 15*a*, 15*b* are driven to engagement in STEP S30, and the recording sheet 11 is cut in pages. Next in STEP S31, the recording sheet 11 is returned by a distance corresponding to an interval between the thermal head 13 and the cutters 13, thus closing the recording process for one page.

Then, the aforementioned value n which is determinative of a feed of the ink sheet 14 may be varied not only by adjusting a rotational frequency of the recording sheet conveying motor 24 and the ink sheet conveying motor 25 but also by modifying reduction ratios of the transfer gears 26, 27 of a drive system of the platen 12 and the transfer gears 28, 29 of a drive system of the take-up roller 18. Further, when the recording sheet conveying motor 24 and the ink sheet conveying motor 25 are constructed both of stepping motors, minimum step angles of the motors can be set from selecting those different each other. Thus, a relative speed of the recording sheet 14 with the ink sheet 14 may be set as $(1+1/n)\ V_P$.

Then, as shown in STEP S23 and STEP S24, it is desirable that the ink sheet conveying motor 25 be driven in advance of the recording sheet conveying motor 24. The reason is that even though the ink sheet conveying motor 25 is driven, there yet remains a time lag before a conveyance of the ink sheet 14 is actually started. Then, a similar effect will also be obtainable from driving the recording sheet conveying motor 24 ahead, however, if the time from start of a conveyance of the recording sheet 11 to actuation of the thermal head 13 (for recording operation shown in STEP S24) is too long, a clearance is capable of arising between recorded dots.

Figure 13:
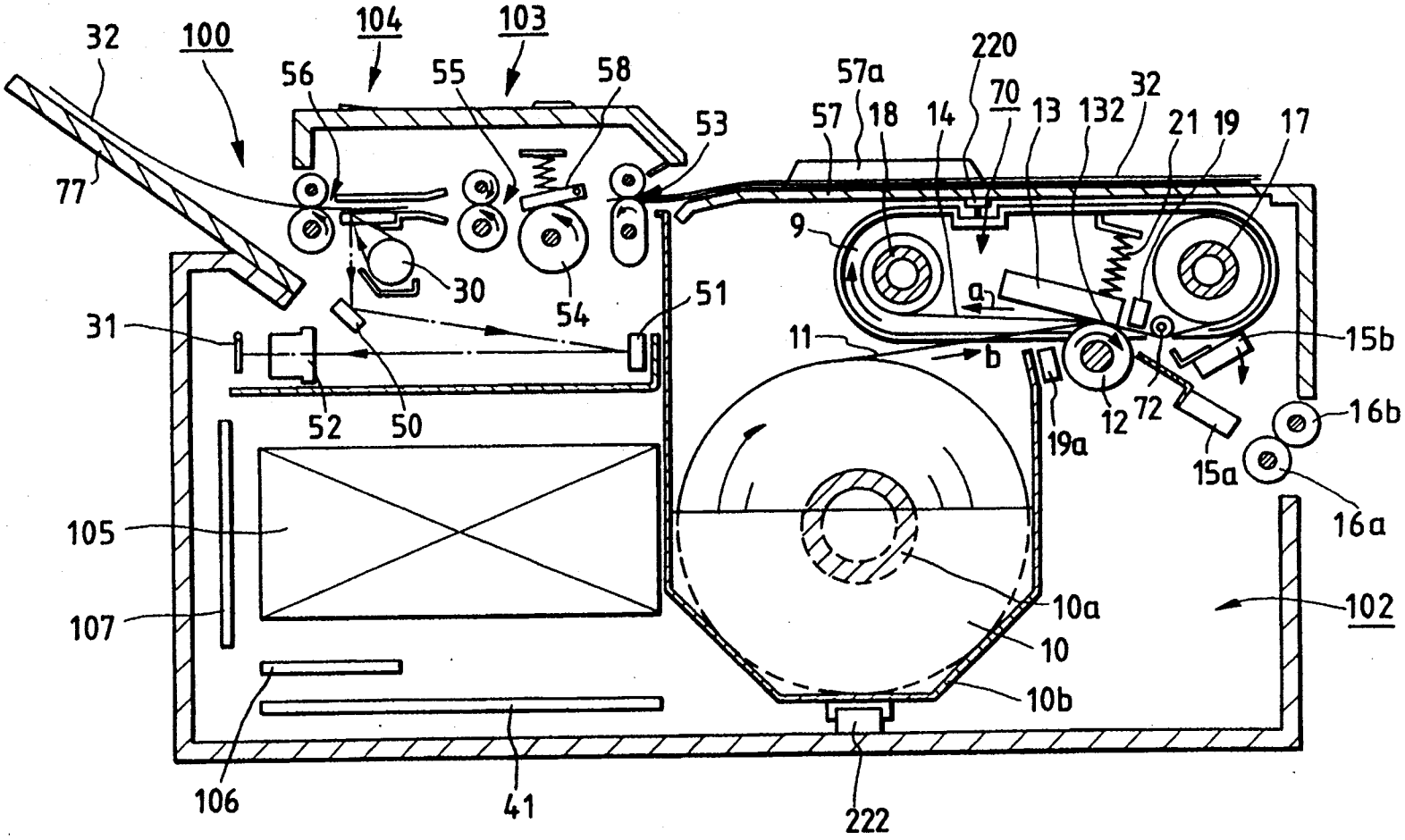
FIG. 13 is a lateral cross-sectional view of a facsimile apparatus in which another embodiment of the present invention is applied.
Figure 14A:
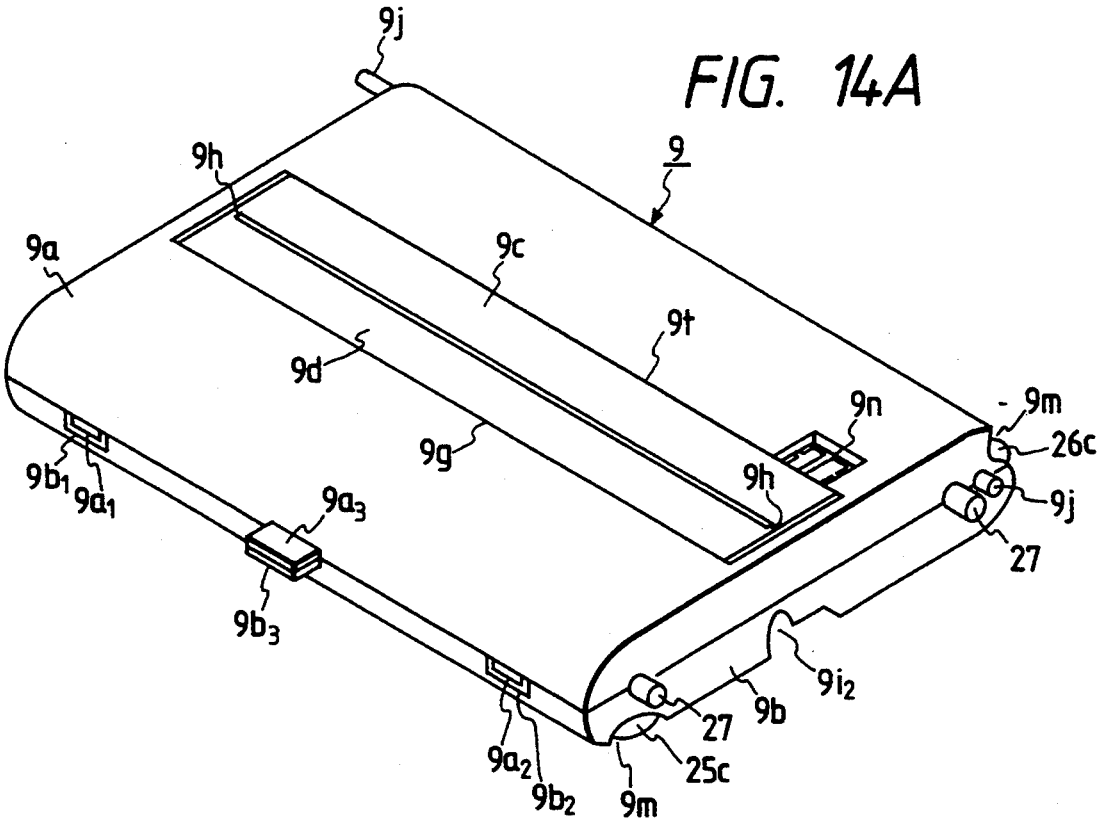
FIG. 14A is a perspective view of an ink sheet cassette loadable into said facsimile apparatus.
Figure 14B:
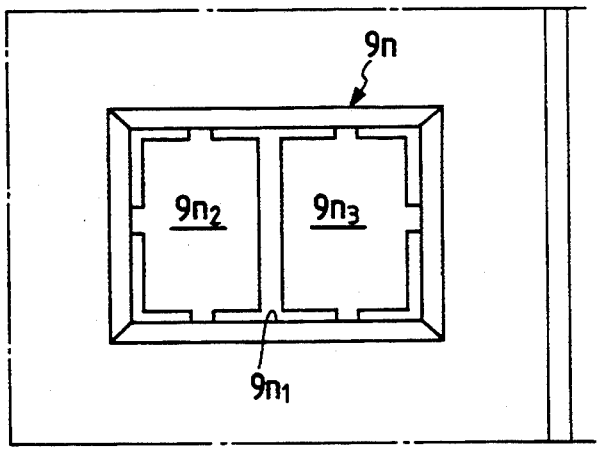
FIG. 14B is a plan view of an identification part of said ink sheet cassette.
Figure 15A:
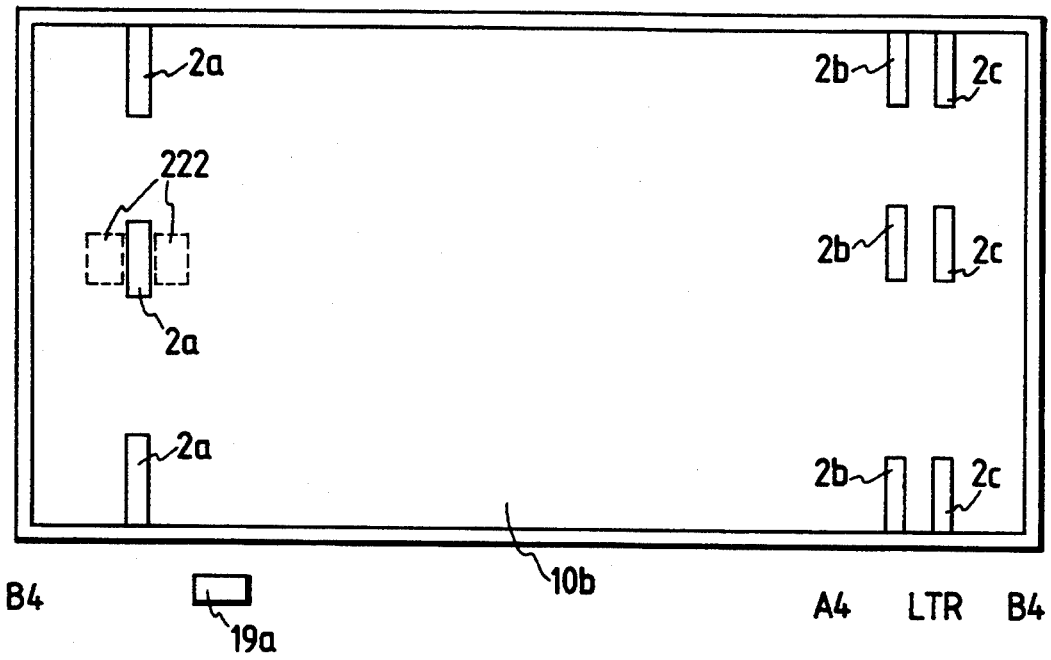
FIG. 15A is a plan view of a loading unit for a rolled recording sheet.
Figure 15B:
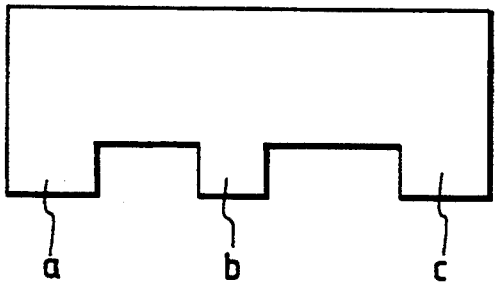
FIG. 15B is a plan view of a partition plate of the mounting unit for the rolled recording sheet.

Now there will be explained another embodiment of the present invention, with reference to FIGS. 13 to 15, wherein FIG. 13 is a lateral cross-sectional view of a facsimile apparatus in which another embodiment of the present invention is applied; FIG. 14A is a perspective view of an ink sheet cassette mountable into said facsimile apparatus; FIG. 14B is a plan view of an identification part of said cassette; FIG. 15A is a plan view of a mounting unit for a rolled recording sheet; and FIG. 15B is a plan view of a partition plate of the mounting unit of said rolled recording sheet.

The following embodiment is to identify the width of the ink sheet by the ink sheet cassette, and that of the recording sheet by the position of a partition plate in the mounting unit 10*b* for said recording sheet. In the foregoing embodiment are represented by same numbers, and will not be explained further. It is assumed that the present facsimile apparatus is capable of recording on the sheets of A4 size, B4 size and letter size.

At first reference is made to FIGS. 13 and 14 for explaining the identification of the width of ink sheet. The ink sheet cassette 9 is constructed in the following manner.

The ink sheet cassette 9, detachably mountable in the mounting unit 70, is provided with a supply reel 17 and a take-up reel 18 in predetermined positions of a frame, with an ink sheet 14 wound on said supply reel 17 and extended to said take-up reel 18. The use of said ink sheet cassette 9 enables easy, secure and stable mounting of the ink sheet 14 in the mounting unit 70 of the recording apparatus.

The ink sheet 14 mounted in the recording apparatus is usually not removed until said sheet 14 is used up, and is thereafter disposed of. Consequently the cassette 9 containing the ink sheet 14 is also considered as disposable, and has therefore to be inexpensive.

Consequently the ink sheet cassette 9 of the present embodiment is formed by integral molding of a plastic material, in order to reduce the number of component parts and the assembly cost.

As shown in the drawing, the cassette 9 is composed of a first casing 9*a*, a second casing 9*b* and doors, 9*c* and 9*d*, formed by integral molding.

More specifically, said integral molding is achieved, by a thinner portion formed in the connecting part between the first and second casings 9*a* and 9*b*; similar thinner portions 9*f* and 9*g* formed in the connections to the doors 9*c* and 9*d* positioned at the approximate center of the first casing 9*a*; and a breakable link portion 9*h* formed between said doors 9*c* and 9*d*.

The first-mentioned thinner portion serves as a hinge for mutually closing the first and second casings 9*a* and 9*b* after the supply reel 17 and the take-up reel 18 are mounted therein. Also the thinner portions 9*f* and 9*g* serve as hinges for the doors 9*c* and 9*d* to be opened by fork members (not shown) on both sides of the recording head 13 when the cassette 9 is mounted in the mounting unit 70.

The link portion 9*h* connecting the doors 9*c* and 9*d* serves to maintain said doors 9*c* and 9*d* in locked state while the cassette 9 is unused, thereby preventing the dust intrusion into the cassette 9. Said link portion 9*h* is so dimensioned as to be easily breakable when the doors 9*c* and 9*d* are opened in contact with the fork member of the recording head 13 at the mounting of the cassette 9 into the mounting unit 70.

The cassette 9 can be molded with a suitable resinous material such as polypropylene resin or ABS resin.

At the approximate center of the second casing 9*b* there is further formed a window, for receiving the platen roller 12, which is connected to a notch $9i_2$ for accommodating the shaft of said platen roller 12. On the curved portions at the open ends of said cassette, there are further provided engaging recesses $9a_2$ in the first casing 9*a*, and corresponding engaging projections $9b_2$ in the second casing 9*b*. Furthermore the first and second casing members 9*a* and 9*b* are respectively provided, on the curved portions ar the open ends thereof, with engaging projections $9a_3$ and $9b_3$ for engaging with springs (not shown) provided in the mounting unit 70 when the cassette 9 is mounted therein. Furthermore, there are formed guide pins 9*j* in predetermined positions on both ends of the side plate $9b_1$ of said second casing member 9*b*, for guiding the cassette 9 at the mounting into the mounting unit 70. The first and second casing members 9*a* and 9*b* are further provided with apertures 9*m* for exposing reel gears 25*c* and 26*c* of the supply reel 17 and the take-up reel 18.

In FIG. 14B, there is shown an identification unit 9*n* to be in contact, when the cassette 9 is mounted in the mounting unit 70, with a sensor 220 provided in the apparatus for identifying the presence of the cassette and the width of the ink sheet 14. A guide pin 27 serves for positioning at the mounting of the cassette 9 into the mounting unit 70.

In said identification unit 9*n*, portions $9n_2$ and $9n_3$ are left intact when the cassette 9 contains the ink sheets 14 of B4 size, but either one of said portions $9n_2$ and $9n_3$ is broken off at the manufacture if the cassette 9 contains the ink sheet 14 of A4 size (210 mm wide) or letter size (216 mm wide). Confusion does not arise between these two sizes because the letter size is used only in the U.S.A.

The aforementioned sensor 220 of the main body is provided with two actuators (not shown). Thus, the cassette 9 is identified to contain B4-sized ink sheets if said two actuators are moved by the portions $9n_2$ and $9n_3$ of the identifying unit 9*n*, but is identified to contain A4- or letter-sized ink sheets if only one of the two actuators is by the unremoved portion $9n_2$ or $9n_3$. The absence of ink sheet cassette 9 is identified if the two actuators are both turned off.

In the following there will be explained the identification of width of the recording sheet 11, with reference to FIGS. 13 and 15.

As shown in FIG. 15A, the mounting section 10*b* is provided with apertures 2*a*, 2*b* and 2*c* at the bottom in the transversal direction. The recording sheet of B4 size is mounted over the entire width. For the sheet of A4 size, partition plates shown in FIG. 15B are fitted in said apertures 2*a* and 2*b* (legs a, b, c of said partition plates being fitted into said apertures). Similarly, for the sheet of letter size, partition plates are fitted in the apertures 2*a* and 2*c*, and the recording sheets are mounted between said partition plates.

A sheet width sensor 222 is provided directly below the aperture 2*a* of the mounting section 10*b*. Thus the recording sheet is identified as A4 size or letter size if the sensor 222 is turned on by the leg b of the partition plate, or as B4 size if the sensor 222 is not turned on even though the presence of recording sheet is detected by the sensor 19*a*.

After the width of the ink sheet 14 and that of the recording sheet 11 are identified by the above-explained structure, the control unit shown in FIG. 7 executes discrimination whether said widths mutually coincide, and control corresponding to the result of said discrimination, according to the sequence shown in FIG. 9. It is to be noted that the ink sheet width sensor 20 is replaced by the ink sheet cassette width sensor 220, and the recording sheet width sensor 22 is replaced by a sensor 222.

[Recording Principle (FIG. 11)]

Figure 11:
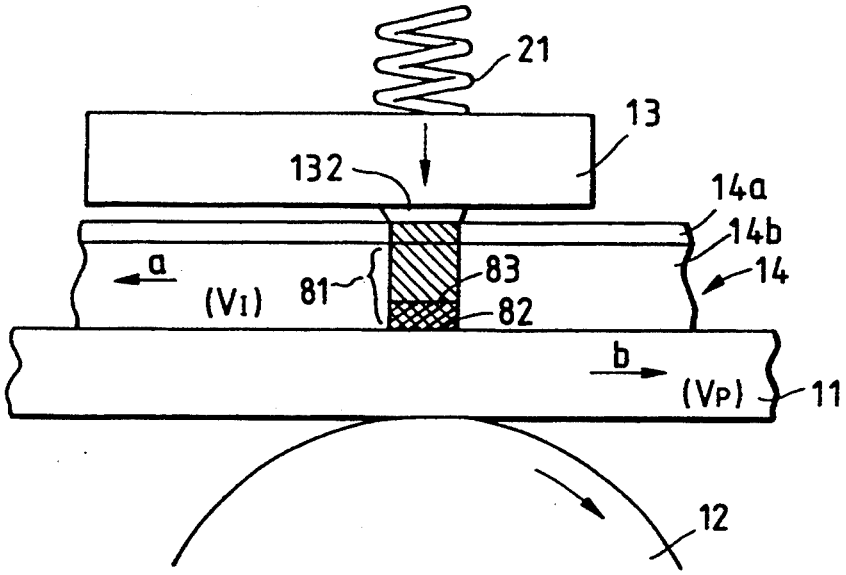
FIG. 11 is a drawing showing a state of the recording sheet and the ink sheet at the time of recording in the embodiment.

FIG. 11 is a drawing showing an image recorded state when recording image by reversing the directions in which the recording sheet 11 and the ink sheet 14 are conveyed in the embodiment.

As illustrated, the recording sheet 11 and the ink sheet 14 are held between the platen 12 and the thermal head 13, and the thermal head 13 is pressed onto the platen 12 by the spring 21 at a predetermined pressure. Here, the recording sheet 11 is conveyed at a speed $V_P$ in the direction indicated by an arrow b according to a rotation of the platen 12. On the other hand, the ink sheet 14 is conveyed at a speed $V_I$ in the direction indicated by an arrow a according to a rotation of the ink sheet conveying motor 25. Then, as will be described hereinlater, the state wherein the ink sheet 14 stops running may be taken.

Now, when the heat generating resistant member 132 of the thermal head 13 is heated on a current carried from the power source 105, an oblique-line portion 81 of the ink sheet 14 is heated. Here, 14*a* denotes a base film of the ink sheet 14, and 14*b* denotes an ink layer of the ink sheet 14. An ink of the ink layer 81 heated by carrying a current to the heat generating resistant member 132 is fused, and a portion 82 is transferred to the recording sheet 11. The transferred ink-layer portion 82 corresponds nearly to l/n of the ink layer indicated by 81.

In this case, it is necessary that a shearing force to the ink be generated at a boundary line 83 of the ink layer 14*b*, thereby transferring only the ink-layer portion 82 to the recording sheet 11. However, the shearing force varies according to a temperature of the ink layer, and generally the higher the ink layer temperature is, the smaller the shearing force becomes. Now, therefore, in view of a shearing force in the ink layer getting large from shortening a heating time of the ink sheet 14, the ink layer to be transferred can be removed securely from the ink sheet 14 by increasing a relative speed of the ink sheet 14 with the recording sheet 11.

According to the present embodiment, a heating time of the thermal head 13 in the facsimile equipment is short at about 0.6 ms, therefore the relative speed of the ink sheet 14 with the recording sheet 11 will be increased by reversing (confronting) the direction in which the ink sheet 14 is conveyed and the direction in which the recording sheet 11 is conveyed.

[Ink Sheet (FIG. 12)]

Figure 12:
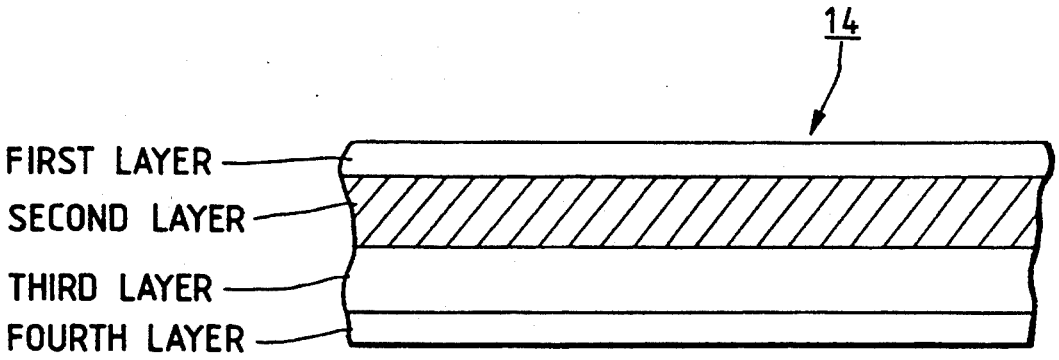
FIG. 12 is a sectional view of the ink sheet used in the embodiment.

FIG. 12 is a sectional view of the ink sheet used for multiprint of the present embodiment, which comprises four layers here.

First, the second layer is a base film working as a support member for the ink sheet 14. In the case of multiprint, a thermal energy is impressed several times on the same portion, therefore a high heat-resisting aromatic polyamide film and an electrostatic capacitor paper are preferable, however, a conventional polyester film is also serviceable. A preferably thin one will be advantageous for printing quality from its working as a medium, however, those of 3 to 8 μm in thickness will be preferable from a viewpoint of strength.

The third layer is an ink layer containing ink much enough to transfer several times to the recording sheet. The ink is then compounded principally of resin such as EVA or the like as an adhesive, carbon black and nigrosine for coloring, carnauba wax and paraffin wax as binding material so as to be serviceable n times at the same portion. The amount of application is preferable at 4 to 8 g/m$^2$, however, sensitivity and density vary according to the amount of application, and hence will be selected arbitrarily.

The fourth layer is a top coating layer for preventing the third-layer ink from being transferred on pressure to the recording sheet at a portion not for printing, which is constructed of a transparent wax or the like. Thus, the transparent fourth layer only is transferred on pressure, and the recording sheet is prevented from being stained. The first layer is a heat-resisting coat layer for protecting the base film of the second layer from a heat of the thermal head 13. This is preferable for the multiprint capable of having thermal energy for n lines impressed on the same portion (when black information comes in series), however, whether or not it is used will be selected properly. Then, it may work effectively on the base film relatively low in heat resistance like polyester film.

A construction of the ink sheet 14 is not necessarily limited to the embodiment, and hence may comprise, for example, a base layer and a porous ink hold layer provided on one side of the base layer to contain ink therein, or that with a heat resisting ink layer having a fine porous netlike structure provided on the base film, ink being contained in the ink layer may be employed otherwise therefor. Then, a material of the base film may take paper or film consisting, for example, of polyamide, polyethylene, polyester, polyvinyl chloride, triacetylcellulose, nylon and the like. Further, the heat-resisting coat layer is not necessarily required, however, its material may take, for example, silicone resin or epoxy resin, fluorine resin, nitrocellulose and the like.

Then, an ink sheet provided with a coloring material layer containing a spacer particle formed of guanamine resin and fluorine resin and a dyestuff on a base material formed of polyethylene terephthalate, polyethylene naphthalate, aromatic polyamide film and the like may be exemplified as the ink sheet having a heat-sublimating ink.

Further, the heating system is not necessary limited to a thermal head system using the aforementioned thermal head, and a current carrying system or a laser transfer system, for example, may be employed.

Then, in the embodiment, widths to be detected by the recording sheet width sensor and the ink sheet width sensor are specified as A4- and B4-sizes both, however, these are not necessarily restrictive, and the case where the ink sheet is larger than the recording sheet by a predetermined amount (about 10 mm, for example) in any sizes such as, for example, A3-size, 11-inch size is taken erroneous.

Still further, widths of the ink sheet and the recording sheet are detected directly in the embodiment, however, when, for example, the ink sheet and the recording sheet are contained in cassettes, a width of the ink sheet or the recording sheet may be detected according to a notch or a mark of the cassettes. Besides, the construction is not necessarily limited to that in which sizes of the ink sheet width and the recording sheet width are discriminated by sensors automatically, and hence operators may input these sizes by hand otherwise to discrimination.

As described above, according to the present embodiment, an advantage is such that an image can be prevented from being recorded defectively due to breakage or wrinkles of the ink sheet by keeping away from recording operation when sizes of the recording sheet and the ink sheet are different.

Then, the recording medium is not restrictive only of a recording sheet, and such material as is capable of ink transfer thereon, or, for example, cloth, plastic sheet and the like may be taken up therefor. Further, the ink sheet is not necessarily limited to the roll construction indicated by the embodiment, and a so-called ink sheet cassette type wherein the ink sheet is incorporated in a housing case detachable on an apparatus body and thus is detachable on the apparatus body as enclosed in the housing case may be employed therefor.

Then, in each embodiment described above, the case where the heat transfer printer is applied to a facsimile equipment has been taken up for description, however, the invention is not necessarily limited thereto, and the recording apparatus of the invention may also be applied, for example, to word processor, typewriter or copying machine.

As described above, according to the present embodiment, an image can be recorded only when sizes of the recording sheet and the ink sheet are coincident, thereby ensuring an effect in preventing wrinkles and breakage of the ink sheet due to a friction between the platen and the ink sheet.

Now, according to the present invention, such recording apparatus as is capable of realizing a high quality image recording may be provided.

What is claimed is:

1. A thermal transfer recording apparatus for recording an image by transferring an ink of an ink sheet to a recording sheet, said apparatus comprising:

recording sheet conveying means for conveying said recording sheet;

ink sheet conveying means for conveying said ink sheet;

a thermal head having a plurality of heat generating elements to selectively transfer said ink to said recording sheet;

first discriminating means for discriminating a width of said recording sheet;

second discriminating means for discriminating a width of said ink sheet;

comparing means for comparing the width of said recording sheet discriminated by said first discriminating means with the width of said ink sheet discriminated by said second discriminating means; and control means for converting recording information to be recorded on the recording sheet to an amount of information for one line corresponding to the width of said ink sheet so as to record on said recording sheet when the width of said ink sheet is less than the width of said recording sheet.

2. An apparatus according to claim 1, wherein when recording is performed said ink sheet is conveyed by said ink sheet conveying means by a first conveyance length which is shorter than a second conveyance length by which said recording sheet is conveyed by said recording sheet conveying means.

3. An apparatus according to claim 1, wherein said ink sheet comprises a multi-print ink sheet having said ink disposed in a manner which allows recording to be performed plural times at a given region of said ink sheet.

4. An apparatus according to claim 1, wherein said apparatus is a facsimile apparatus having a receiving mechanism for receiving an image information for recording said image through an outside communication line.

5. A thermal transfer recording apparatus for recording an image by transferring an ink of an ink sheet to a recording sheet, said apparatus comprising:

recording sheet conveying means for conveying said recording sheet;

ink sheet conveying means for conveying said ink sheet;

a thermal head having a plurality of heat generating elements to selectively transfer said ink to said recording sheet;

first discriminating means for discriminating a width of said recording sheet;

second discriminating means for discriminating a width of said ink sheet;

comparing means for comparing the width of said recording sheet discriminated by said first discriminating means with the width of said ink sheet discriminated by said second discriminating means; and control means for reducing a first amount of recording information to a second amount of recording information to be recorded on said recording sheet, when the width of said ink sheet is less than the width of said recording sheet and said first amount exceeds said second amount, said first amount being an amount of recording information to be recorded for one line and said second amount being an amount of recording information which is recordable for the width of said ink sheet.

6. An apparatus according to claim 5, wherein when recording is performed said ink sheet is conveyed by said ink sheet conveying means by a first conveyance length which is shorter than a second conveyance length by which said recording sheet is conveyed by said recording sheet conveying means.

7. An apparatus according to claim 5, wherein said ink sheet comprises a multi-print ink sheet having said ink disposed in a manner which allows recording to be performed plural times at a given region of said ink sheet.

8. An apparatus according to claim 5, wherein said apparatus is a facsimile apparatus having a receiving mechanism for receiving an image information for recording said image through an outside communication line.

9. A thermal transfer recording apparatus for recording an image by transferring an ink of an ink sheet to a recording sheet, said apparatus comprising:

recording sheet conveying means for conveying said recording sheet;

ink sheet conveying means for conveying said ink sheet;

a thermal head having a plurality of heat generating elements to selectively transfer said ink to said recording sheet;

first discriminating means for discriminating whether a width of said recording sheet is a first size or a second size which is larger than the first size;

second discriminating means for discriminating whether a width of said ink sheet is the first size or the second size which is larger than the first size; and control means for reducing an amount of recording information to be recorded for one line to a recording information amount corresponding to the first size to be recorded on said recording sheet, when the width of said recording sheet is the second size, the width of said ink sheet is the first size and said amount of recording information to be recorded for one line is equal to a recording information amount corresponding to the second size.

10. An apparatus according to claim 9, wherein when recording is performed said ink sheet is conveyed by said ink sheet conveying means by a first conveyance length which is shorter than a second conveyance length by which said recording sheet is conveyed by said recording sheet conveying means.

11. An apparatus according to claim 9, wherein said ink sheet comprises a multi-print ink sheet having said ink disposed in a manner which allows recording to be performed plural times at a given region of said ink sheet.

12. An apparatus according to claim 9, wherein said apparatus is a facsimile apparatus having a receiving mechanism for receiving an image information for recording said image through an outside communication line.

13. A thermal transfer recording method of recording an image by transferring an ink of an ink sheet to a recording sheet, said method comprising the steps of:

conveying said recording sheet;

conveying said ink sheet;

transferring said ink selectively to said recording sheet using a thermal head having a plurality of heat generating elements;

a first step of discriminating a width of said recording sheet;

a second step of discriminating a width of said ink sheet;

comparing the width of said recording sheet discriminated in said first discriminating step with the width of said ink sheet discriminated in said second discriminating step; and converting recording information to be recorded on the recording sheet to an amount of information for one line corresponding to the width of said ink sheet so as to record on said recording sheet when the width of said ink sheet is less than the width of said recording sheet.

14. A method according to claim 13, wherein when recording is performed said ink sheet is conveyed in said ink sheet conveying step by a first conveyance length which is shorter than a second conveyance length by which said recording sheet is conveyed in said recording sheet conveying step.

15. A method according to claim 13, wherein said ink sheet comprises a multi-print ink sheet having said ink disposed in a manner which allows recording to be performed plural times at a given region of said ink sheet.

16. A method according to claim 13, further comprising the step of receiving an image information for recording said image through an outside communication line, and wherein said recording is performed using a facsimile apparatus having a receiving mechanism for receiving said image information.

17. A thermal transfer recording method of recording an image by transferring an ink of an ink sheet to a recording sheet, said method comprising the steps of:

conveying said recording sheet;

conveying said ink sheet;

transferring said ink selectively to said recording sheet using a thermal head having a plurality of heat generating elements;

a first discriminating step of discriminating a width of said recording sheet;

a second discriminating step of discriminating a width of said ink sheet;

comparing the width of said recording sheet discriminated in said first discriminating step with the width of said ink sheet discriminated in said second discriminating step; and reducing a first amount of recording information to a second amount of recording information to be recorded on said recording sheet, when the width of said ink sheet is less than the width of said recording sheet and said first amount exceeds said second amount, said first amount being an amount of recording information to be recorded for one line and said second amount being an amount of recording information which is recordable for the width of said ink sheet.

18. A method according to claim 17, wherein when recording is performed said ink sheet is conveyed in said ink sheet conveying step by a first conveyance length which is shorter than a second conveyance length by which said recording sheet is conveyed in said recording sheet conveying step.

19. A method according to claim 17, wherein said ink sheet comprises a multi-print ink sheet having said ink disposed in a manner which allows recording to be performed plural times at a given region of said ink sheet.

20. A method according to claim 17, further comprising the step of receiving an image information for recording said image through an outside communication line, and wherein said recording is performed using a facsimile apparatus having a receiving mechanism for receiving said image information.

21. A thermal transfer recording method of recording an image by transferring an ink of an ink sheet to a recording sheet, said method comprising the steps of:

conveying said recording sheet;

conveying said ink sheet;

transferring said ink selectively to said recording sheet using a thermal head having a plurality of heat generating elements;

a first discriminating step of discriminating whether a width of said recording sheet is a first size or a second size which is larger than the first size;

a second discriminating step of discriminating whether a width of said ink sheet is the first size or the second size which is larger than the first size; and reducing an amount of recording information to be recorded for one line to a recording information amount corresponding to the first size to be recorded on said recording sheet, when the width of said recording sheet is the second size, the width of said ink sheet is the first size and said amount of recording information to be recorded for one line is equal to a recording information amount corresponding to the second size.

22. A method according to claim 21, wherein when recording is performed said ink sheet is conveyed in said ink sheet conveying step by a first conveyance length which is shorter than a second conveyance length by which said recording sheet is conveyed in said recording sheet conveying step.

23. A method according to claim 21, wherein said ink sheet comprises a multi-print ink sheet having said ink disposed in a manner which allows recording to be performed plural times at a given region of said ink sheet.

24. A method according to claim 21, further comprising the step of receiving an image information for recording said image through an outside communication line, and wherein said recording is performed using a facsimile apparatus having a receiving mechanism for receiving said image information.

* * * * *

UNITED STATES PATENT AND TRADEMARK OFFICE

CERTIFICATE OF CORRECTION

PATENT NO. : 5,418,554

DATED : May 23, 1995

INVENTOR(S) : Masao Kiguchi, et al.

It is certified that error appears in the above-indentified patent and that said Letters Patent is hereby corrected as shown below:

[57] Abstract

Line 7, "effecting" should read --effecting transfer from--.

COLUMN 2

Line 21, "a" should read --an--.

COLUMN 5

Line 29, "singal" should read --signal--.

COLUMN 6

Line 17, "an" should read --and--.

COLUMN 8

Line 67, "different" should read --different from--.

COLUMN 10

Line 39, "cutters 13," should read --cutters 15a, 15b,--;

Line 52, "different" should read --different from--; and

Line 53, "14" (first occurrence) should read --11--.

UNITED STATES PATENT AND TRADEMARK OFFICE

CERTIFICATE OF CORRECTION

PATENT NO. : 5, 418,554

DATED : May 23 ,1995

INVENTOR(S) : Masao Kiguchi et al.

It is certified that error appears in the above-indentified patent and that said Letters Patent is hereby corrected as shown below:

COLUMN 12

Line 10, "ar" should read --at--.

COLUMN 14

Line 3, "much" should read --sufficient--;

Line 49, "necessary" should read --necessarily--; and

Line 60, "is taken erroneous" should read --may be treated as a sheet size error--.

Signed and Sealed this

Thirty-first Day of October 1995

Bruce Lehman

*Attest:*

BRUCE LEHMAN

*Attesting Officer*

*Commissioner of Patents and Trademarks*